United States Patent [19]

Nelson

[11] Patent Number: 4,964,250

[45] Date of Patent: Oct. 23, 1990

[54] MODULAR ACOUSTICAL PANEL AND METHOD OF MAKING SAME

[75] Inventor: Thomas E. Nelson, Anchorage, Ky.

[73] Assignee: Soltech, Inc., Shelbyville, Ky.

[21] Appl. No.: 400,740

[22] Filed: Aug. 30, 1989

[51] Int. Cl.[5] ..... E04B 1/82

[52] U.S. Cl. ..... 52/144; 52/145; 52/238.1; 52/809

[58] Field of Search ..... 52/144, 145, 809, 813, 52/406, 239, 238.1

[56] References Cited

U.S. PATENT DOCUMENTS

| | | | |
|---|---|---|---|
| 2,350,513 | 6/1944 | Leadbetter | 52/145 |
| 3,193,061 | 7/1965 | Downes . | |
| 3,768,222 | 10/1973 | Birum, Jr. . | |
| 3,934,382 | 1/1976 | Gartung | 52/144 |
| 4,021,973 | 5/1977 | Hegg et al. . | |
| 4,094,113 | 6/1978 | Good | 52/238.1 X |
| 4,231,197 | 11/1980 | Caplan et al. . | |

FOREIGN PATENT DOCUMENTS 2747637 11/1978 Fed. Rep. of Germany .

*Primary Examiner*—Richard E. Chilcot, Jr.

*Attorney, Agent, or Firm*—Woodard, Emhardt, Naughton Moriarty & McNett

[57] ABSTRACT

A modular acoustical panel for use in separating and dividing an interior space includes a generally hollow, open frame member having a generally rectangular wall portion which surrounds and defines a core-receiving space. A modular septum which is arranged with a center partition offset so as to have a surrounding wall and surrounding flange is preassembled with two layers of insulating material on opposite sides of the center portion of the offset partition. The modular septum is able to be assembled off-line and brought to the point of final assembly into the frame. The center portion of the modular septum and the two layers of insulating material are inserted into the core-receiving space and the outer flange of the partition attaches directly to the outer surface of the frame on one side. A spacer is provided on the opposite side to make the thickness symmetrical and thus account for the thickness of the flange portion. When the assembly of the modular septum to the frame member is completed, the entire assembly is covered with exterior material applied to both sides of the panel.

17 Claims, 4 Drawing Sheets

MODULAR ACOUSTICAL PANEL AND METHOD OF MAKING SAME

BACKGROUND OF THE INVENTION

The present invention relates in general to acoustical panels and partitions. More particularly, the present invention relates to acoustical panels and partitions which include a dividing septum and modular component parts.

In one arrangement, acoustical panels and partitions may be constructed as free-standing units such as that disclosed in U.S. Pat. No. 3,768,222 issued to Birum, Jr. on Oct. 30, 1973; and U.S. Pat. No. 4,021,973 issued May 10, 1977 to Hegg et al. In another arrangement, the panels may be part of an integrated wall partition system which would use intricate fittings, connectors and locking features in order to join and interlock the partitions together. Representative of this construction in addition to the Hegg et al. patent are U.S. Pat. No. 3,193,061 issued July 6, 1965 to Downes, and West German Patent No. 2747637 issued Nov. 5, 1978 which is based on an earlier Japanese application. Structural partition systems typically include walls which mount into floor and ceiling tracks and may include shelving which mounts to the walls. Typical of this construction are the systems disclosed in Downes and in U.S. Pat. No. 4,231,197 issued Nov. 4, 1980 to Caplan et al.

In a fully integrated system, the acoustical partitions which are usually five or six feet high include a compatible construction in order to interlock the floor and ceiling tracks as well as edge strips Alternatively, acoustical panels and partitions may be constructed as movable, free-standing units which are designed to support themselves partly by their own weight and partly by the design of the surrounding rigid frame. These types of panels and partitions typically include, in addition to the outer frame, an acoustical core and an outer covering applied over the core and frame assembly. The inner core includes a layer or layers of acoustical insulating material such as fiberglass and may also include a dividing septum. When a septum is included, there is typically a layer of fiberglass on each side of the septum. The septum material may be fiberboard, metal, plastic, or a composite of these and/or other materials. The septum is usually positioned at the midpoint of the panel depth or thickness and serves as an acoustical barrier and in some cases as a structural component of the rigid panel frame.

Attachment of the septum within the frame most often is done by welding if metal is used for the frame and septum. This construction approach requires that the septum be assembled before the insulating material is applied to the septum in order to have clearance access and in order to prevent the high welding temperatures from adversely affecting the insulation material.

Alternatively, the septum may be assembled to the frame using a somewhat complex mechanical fastening method, such as clips, which are rigidly secured to the inner edge of the surrounding frame and which represent an additional cost factor. In order to provide the requisite strength and rigidity to the frame and septum assembly, these clips must be substantial in material thickness and design and configured for easy assembly of the septum. Nevertheless, and regardless of whichever construction and assembly approach is followed for the septum, the assembly of the septum to the frame must be done before the layers of acoustical insulating material can be applied to the septum and thereafter the entire structure covered with an outer fabric layer. The many steps required for assembly of the described conventional acoustical panels represents an inefficiency in assembly time, location, and personnel. The steps of providing the frame, assembly of the septum and lamination of the insulating layers and coverings must be done at the final assembly site and cannot be done off line in a modular fashion. The work must be done to the entire assembly at the final assembly location and thus, this approach precludes the ability to take advantage of the time, cost, and personnel savings and other off-line manufacturing efficiencies.

The present invention creates an acoustical partition (panel) with assembly efficiencies due to the configuration of the septum. The septum of the present invention is styled so that it can be securely assembled to the frame after the layers of acoustical insulating material are aPplied to the septum. A a result, the septum can be finished off-line in a variety of styles with a variety of material combinations and laminations. By completing the septums off-line the assembly personnel do not have to deal with and work around the frame, and thus the assembly work can be done more efficiently and more easily. Further, it is easier to have a variety of septum styles and materials and greater freedom at the final assembly to pick the desired septum which is already fabricated in modular form and simply assemble it to the desired frame configuration.

When the finished septum is to be assembled to the frame, prior to final covering of the frame and septum with an outer layer, this particular step is performed by attachment of the septum to the outer flange or outer surface portion of the frame. The layers of insulating material applied to the septum prior to final assembly do not interfere with this assembly step and there is direct accessibility to the frame surface to which the septum assembly is attached. This not only enables the use of a modular septum subassembly, but also reduces the total assembly time for the finished frame.

SUMMARY OF THE INVENTION

A modular acoustical panel for use in separating and dividing interior space according to one embodiment of the present invention comprises a frame member having a portion which surrounds and defines a core-receiving space, a modular septum attached to the frame member and including two layers of insulating material separated by an offset partition and exterior covering means disposed over each layer of insulating material.

One object of the present invention is to provide an improved acoustical panel.

Related objects and advantages of the present invention will be apparent from the following description.

DESCRIPTION OF THE PREFERRED EMBODIMENT

Figure 1:
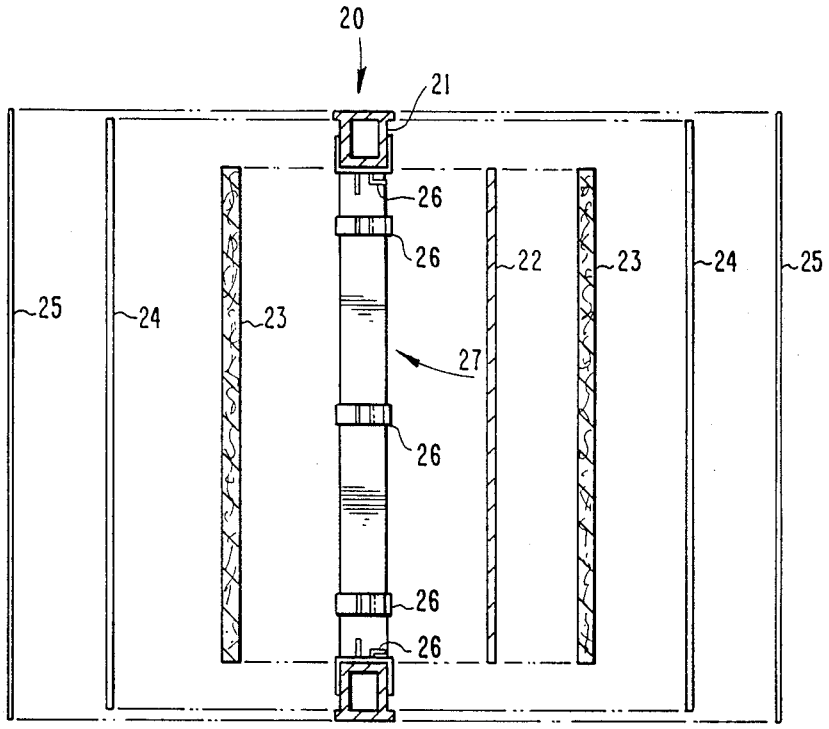
Fig.1 PRIOR ART
FIG. 1 is a side elevational, exploded view of a typical embodiment of a prior art acoustical panel.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated in exploded-view form a prior art acoustical panel 20 which includes a generally rectangular hollow frame 21, septum 22, inner layers of acoustical insulating material 23, outer layers of insulating material 24 and decorative outer coverings 25. All of the layers of material are substantially flat, generally rectangular and may be constructed of a variety of materials which are selected based upon acoustical insulating properties and in the case of coverings 25, also the color and texture.

Frame 21 is illustrated in full section in order to show interior features. The inside edge surface of the frame 21 is provided with a plurality of mechanical clips 26. A minimum of three clips are disposed on each vertical inner edge surface of the frame and a minimum of two clips each are used on the two horizontal inner edge surfaces of the frame. The hollow frame surrounds and defines an interior core space 27 and it is this space which receives septum 22, and the two inner layers of insulation 23. Septum 22 is designed to rigidly attach to the frame via the clips 26 and thereafter the two inner layers of acoustical insulation material are assembled to the septum (on opposite sides).

The rectangular size and shape of interior core space 27 is substantially the same as septum 22 and material layers 23. The combined thickness of septum 22 and both layers 23 is substantially equal to the thickness of frame 21 such that once the septum and the two layers are assembled, the exterior surface of each layer 23 is substantially flush with the outer surfaces of the frame. Layers 24 and 25 each have a generally rectangular size and shape substantially the same as the frame. These relative sizes and their alignment in the assembly of the final panel 20 are represented in part by the broken lines.

As mentioned in the background discussion, in order to securely attach the septum to the frame, either by the disclosed clips 26 or alternatively by welding, the inner insulating layers 23 cannot be assembled to the septum until after the septum is attached to the frame. This required sequence of steps necessitates additional steps and time in completing the final assembly and results in a more awkward procedure because the entire frame must be worked on and around in order to complete all assembly steps.

Figure 1A:
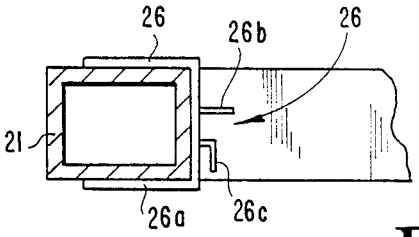
Fig.1A PRIOR ART
FIG. 1A is a partial top plan view in full section illustrating one of a plurality of mechanical clips attached to the FIG. 1 frame.
Figure 1B:
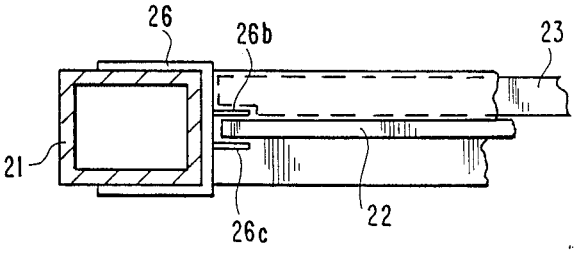
Fig.1B PRIOR ART
FIG. 1B is a partial top plan view in full section of the FIG. 1A clip assembly as attached to a panel septum.

The specific configuration of each clip 26 is illustrated in FIGS. 1A and 1B and these two figures show the assembly sequence of the septum into the clips. Each clip 26 includes a three-sided sleeve 26*a* which wraps around part of the frame 21. Disposed on the interior (within interior core space 27) are prongs 26*b* and 26*c* which are initially oriented as in the FIG. 1A illustration. When the septum is installed its outer peripheral edge abuts against prong 26*b* and fits snugly between the two prongs. Thereafter, the second prong 26*c* is bent toward the septum in order to complete the assembly.

As is intended to be illustrated by the broken, line form of insulation layer 23, the prongs 26*b* and 26*c* cannot be properly accessed if the layers of insulation are applied to the septum prior to assembly of the septum to the clips within the frame. Consequently, the insulation layers must be assembled after the septum is attached to the frame. An alternative when clips or welding must be used is to substantially reduce the size of the insulation layers so that there is a substantial gap between the outer edge of the insulating layer and the inner edge of the frame wall. The obvious problem with this approach is the inferior insulating properties of the final assembly due to the substantial gap which is left between the edge of the insulation and the edge of the frame.

Figure 2:
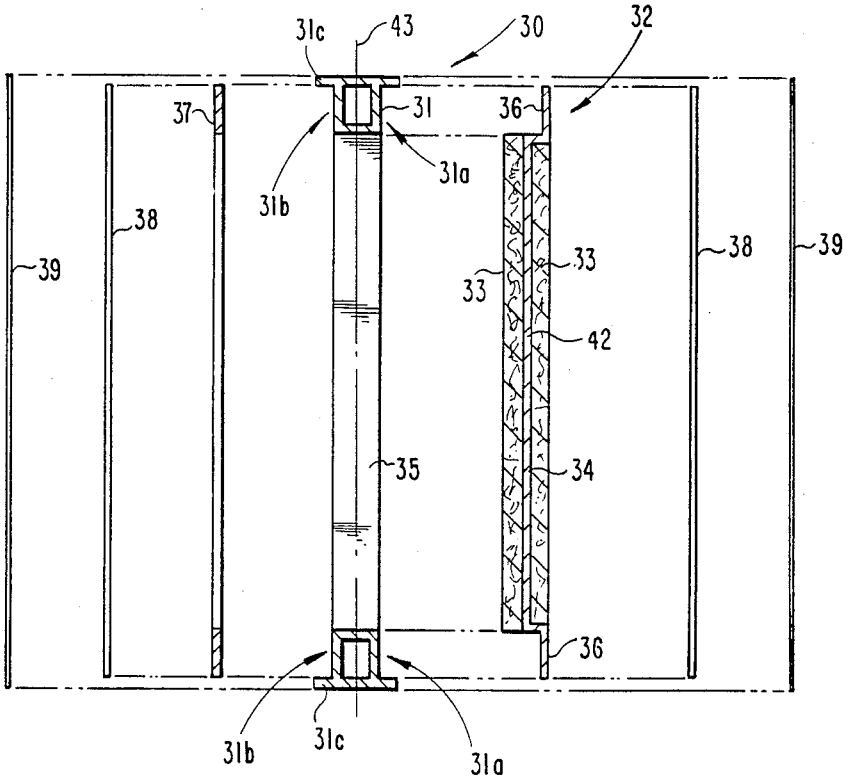
FIG. 2 is a side elevational, exploded view of a modular acoustical panel according to a typical embodiment of the present invention.

With reference to FIG. 2, an improvement to the prior art structure 20 of FIG. 1 is offered by modular acoustical panel 30. Although the completed panel 30 is designed to be free-standing and movable with a hollow, generally rectangular frame 31, the "modular" reference is used instead to refer to modular septum 32 and the fact that it can be assembled off-line and then brought to the final assembly location and easily assembled directly to the frame.

Modular septum 32 includes two oppositely disposed layers 33 of acoustical insulation material assembled to opposite side surfaces of offset partition 34. The two layers 33 of material and the center portion of the partition are sized and shaped to fit snugly within the generally rectangular interior core space 35. The remainder of the assembly of panel 30, as shown in the exploded view, is similar to what was illustrated and described with reference to FIG. 1, with one exception. The stepped or offset outer margin or flange 36 of the partition 34 is assembled to the frame by direct attachment to the outer surface 31*a* of the frame. As a result, there is an added thickness of material applied to one side of the frame. In order for the thickness to have symmetry and to be maintained in a symmetrical fashion throughout the entire thickness of the assembly, a spacer 37 is assembled to the opposite side 31*b* of the frame in order to account for the thickness of the partition flange which is attached to the other side of the frame.

As described, the modular septum can be easily and efficiently assembled off-line from the rest of the panel assembly and by having to deal only with three components which are smaller than the frame and can be easily worked around and worked on in virtually any orientation, total assembly time for the completed panel is less. When all assembly steps must be made directly to the entire frame, its size and upright orientation present additional labor and personnel inefficiencies.

As should be understood, the selection of material for layers 33 and partition 34 encompass a wide range. As one option, though not illustrated, the combined thickness of layers 33 and the center portion 42 of partition 34 is substantially equal to the overall thickness of the frame as measured across the width of lip 31*c* such that when assembled and flange 36 abuts up against frame surface 31*a*, the outer surface of the left (as viewed in FIG. 2) layer 33 is flush with the left outer surface edge of lip 31*c* and thus extends beyond surface 31*b*. Spacer 37 is a substantially flat member with a rectangular size and shape equal to that of the frame and must have a thickness equal to the thickness of flange 36 in order to maintain the desired symmetry. After assembly of the modular septum and spacer, outer layers 38 of insulating material are applied and thereafter decorative outer covering 39 is applied to both sides and the full surface area of the panel. Layers 38 may be sized equal to flange 36 or to covering 39.

As another option, as illustrated in FIG. 2, layers 38 have a peripheral size and shape substantially the same as flange 36. Thus when this size is selected for layers 38 the various dimensions and thicknesses need to be adjusted so that the combined thickness of flange 36 and layer 38 is equal to the offset of lip 31*c* relative to surface 31*a*. Center portion 42 of the modular septum 32 is of a substantially rectangular size and shape equal in both respects to the interior core space 35. Outer flange 36 is of a substantially rectangular size and shape equal in both respects to frame 31. In order to maintain panel symmetry in the lateral direction (thickness) the direction of the offset between center portion 42 and flange 36 is one-half the thickness of the hollow frame. Consequently, centerline 43 of frame 31 is the centerline of the final panel and is likewise the centerline of portion 42.

Figure 2A:
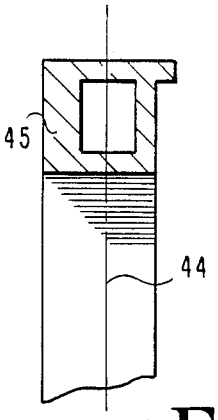
FIG. 2A is a partial, side elevational view of an alternative frame configuration according to the present invention.

Referring to FIG. 2A, an alternative to the use of spacer 37 is illustrated. By shifting the symmetry of the frame opening 44 a dimension equal to the thickness of flange 36 a thicker section or wall 45 is provide on the "left" side of the frame. This thicker section is in effect equal in thickness to the normal frame wall thickness plus the thickness of the partition flange which was made up by the spacer of FIG. 2. By the special configuration of the frame of FIG. 2A, the spacer 37 can be eliminated.

In the preferred embodiment, the frame 31 is constructed of a rigid, high-density plastic, "Masonite" board, paper board, chip board or metal. The partition is a rigid, high-density plastic or metal and layers 33 are fiberglass. Layers 38 are fabricated from fiberglass and the decorative covering is a glass or fabric cloth.

Figure 3:
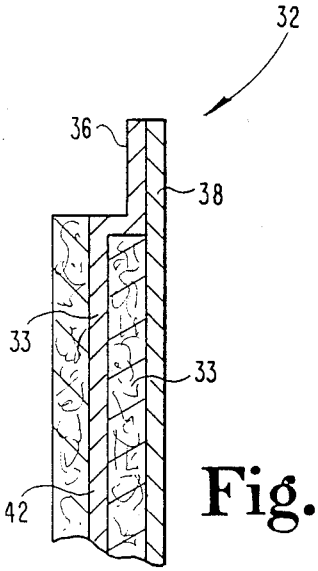
FIG. 3 is a side elevational view of a modular core which is suitable for use in the FIG. 2 embodiment according to the present invention.

Referring to FIG. 3, a further variation to the construction of panel 30 of FIG. 2 is illustrated. The illustrated variation involves the preassembly of layer 38 onto modular septum 32. While layer 38 is a substantially flat, generally rectangular sheet of material, its outer rectangular size and shape is equal in both respects to flange 36. This preassembly option requires that layer 38 be arranged so that the septum can still be attached directly to the outer surface 31*a* of frame 31. This preassembly approach contributes to the modular concept addressed by the present invention.

Figure 4:
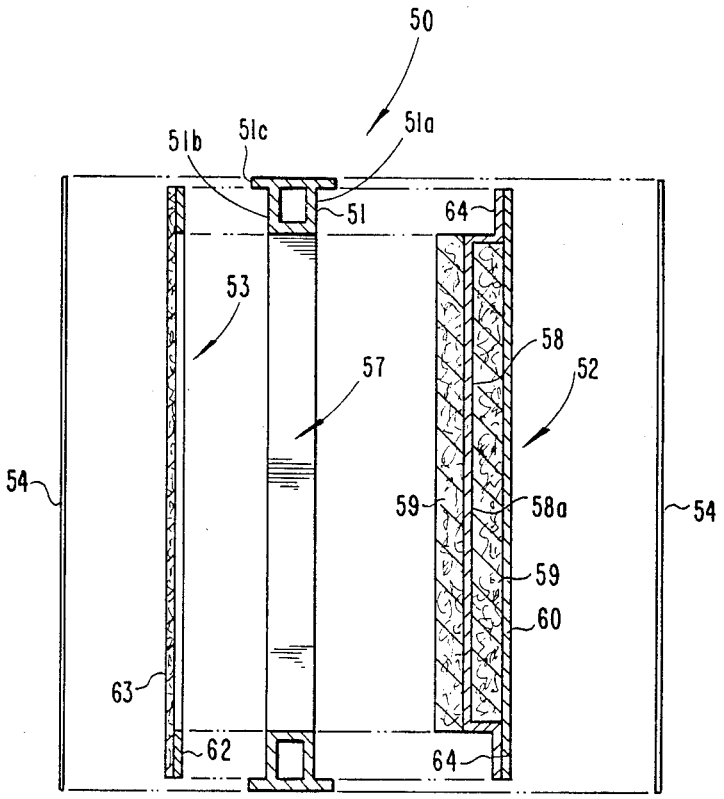
FIG. 4 is a side elevational, exploded view of a modular acoustical panel according to a typical embodiment of the present invention.

Referring to FIG. 4, an alternative embodiment of the present invention is illustrated by the structure of acoustical panel 50. Panel 50 includes a generally rectangular frame 51, modular septum assembly 52, spacer assembly 53 and outer decorative coverings 54. The general sizes, shapes, interfaces and functions already described with respect to FIGS. 2, 2A, and 3 are consistent with and applicable to the construction of panel 50.

Frame 51 is hollow, generally rectangular and defines a core-receiving interior space 57. Septum assembly 52 includes partition 58, two layers 59 of acoustical insulating material, and substantially flat and generally rectangular layer 60 of insulation material. Consistent with what was described relative to FIG. 3, these four components can be assembled off-line and brought to the final assembly of the frame and easily and efficiently attached to the frame. The combined thickness of layers 59, center portion 58*a* of the partition 58, layer 60 and layer 63 equals the thickness of the frame between the outer surfaces of lip 51*c*. The combined thickness of flange 64 and layer 60 equals the offset between surface 51*a* and the edge of lip 51*c*. The combined thickness of spacer 62 and layer 63 is equal to the offset between surface 51*b* and the edge of lip 51*c*. The rectangular size and shape of layers 59 and portion 58*a* are equal in both respects to that of the interior space 57.

Spacer assembly 53 includes spacer 62 and layer 63 of insulation material. Consistent with earlier embodiments, layer 63 and layer 60 are virtually identical. Similarly, spacer 62 is the same size, shape and thickness of flange 64 of partition 58. By the preassembly of the septum assembly and spacer assembly, the final assembly steps are minimized. The septum assembly fits directly into the frame and is securely fastened thereto. On the opposite side of the frame the spacer assembly is attached directly to the frame. The final step is to attach the outer decorative coverings 54 on opposite sides of the assembled panel. These coverings have a generally rectangular size and shape which are virtually identical in these respects to the frame. The broken lines represent the general positions and alignment of the component parts of panel 50 as they fit together.

Figure 5:
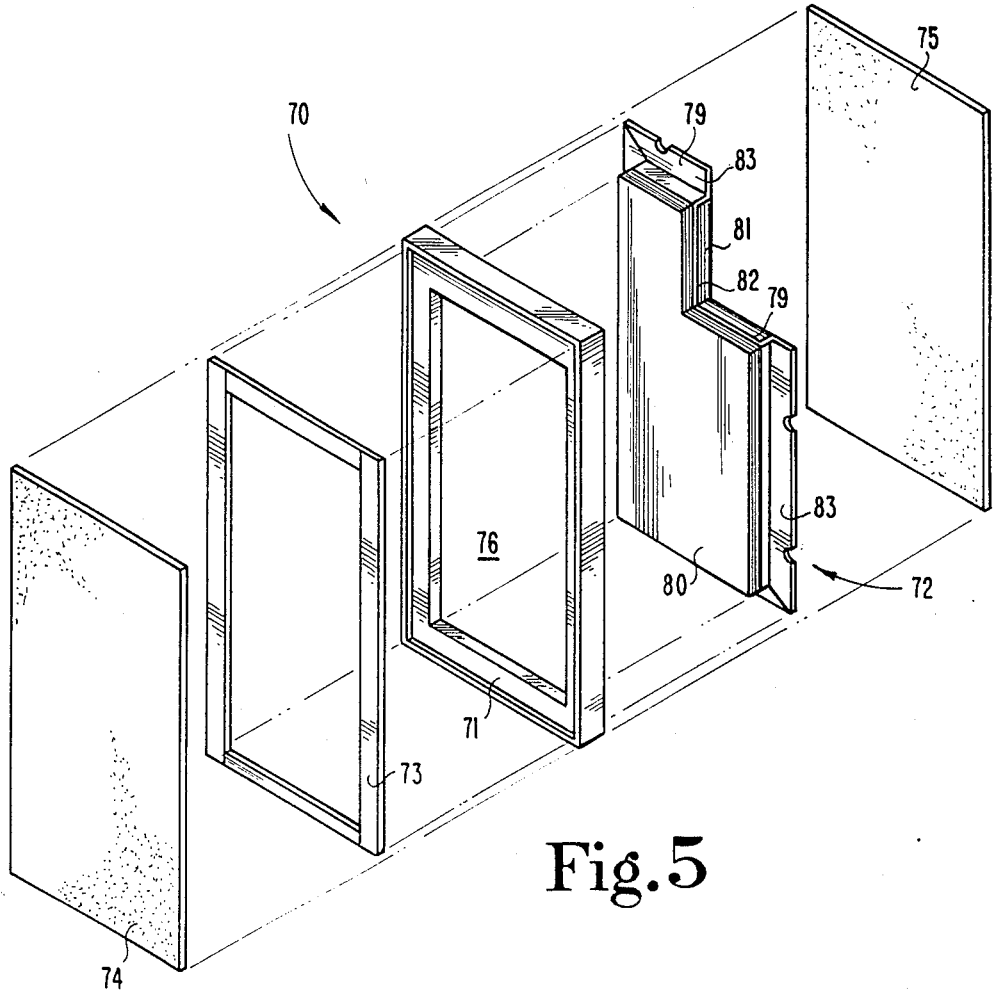
FIG. 5 is a perspective, exploded view of a modular acoustical panel according to a typical embodiment of the present invention.

Referring to FIG. 5, there is illustrated in exploded-view form acoustical panel 70 according to another embodiment of the present invention. Panel 70 includes generally rectangular frame 71, septum assembly 72, generally rectangular spacer 73 and generally rectangular tack boards 74 and 75. Frame 71 includes a surrounding wall portion which defines interior space 76 which receives the center portion of septum assembly 72.

Septum assembly 72 includes offset partition 79, first side layer of acoustical insulation material 80 and opposite side layer of acoustical insulation material 81. Each layer of acoustical insulation material is substantially rectangular and preassembled to partition 79. The partition includes a center portion 82 and an outer flange 83 which is notched for direct attachment to the outer surface of frame 71.

Figure 5A:
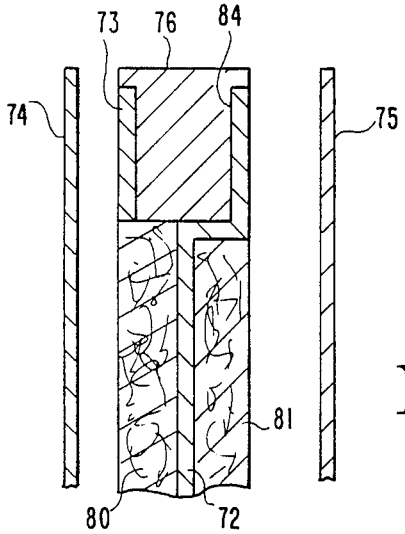
FIG. 5A is a partial, side elevational view of the FIG. 5 acoustical panel as assembled.

With reference to FIG. 5A, the stacked-together and assembled configuration of the various component parts of panel 70 are illustrated. Frame 71 includes an offset outer surface on each side wherein the depth of the offset 84 on one side is equal to the thickness of flange 83 and on the opposite side is equal to the thickness of spacer 73 as is illustrated. This offset depth on the frame's outer surface may also be employed as part of the FIG. 4 embodiment. The combined thickness of the two layers 80 and 81 and center portion 82 is equal to the thickness or depth of the frame and spacer 73 is provided to match or compensate for the flange 83 in order to maintain Panel symmetry throughout its thickness.

Tack boards 74 and 75 are sized to fit over the entirety of the frame and as such these two boards are substantially flat and have a contour peripheral size and shape virtually identical to the frame. The result of the illustrated structure is to enable a quick and easy assembly of the acoustical panel. Once the component parts are fabricated and in the case of the septum assembled and brought to the point of final assembly, only three straightforward steps are required. The first step is to attach the septum assembly into the frame. Next the spacer is attached and finally both tack boards are applied over the entirety of both outer surfaces.

Consistent with and applicable to all illustrated embodiments, the frames are designed so as to be moldable out of a rigid plastic such that the surrounding portion can be hollow, as in FIGS. 2, 2A and 4, and intricately shaped with precisely held tolerances as illustrated in FIG. 5. Alternatively, the frame can be constructed out of other rigid material such as wood or metal. With regard to the inner layers of acoustical insulation material, this would typically be a thickness of fiberglass cut from mats or batts of material. Another option is to prepare each layer as an insulation-filled pouch wherein the enclosing envelope is preferably an impermeable material which will not allow moisture to affect the interior insulation. This interior insulation may be fiberglass or a particulate which is selected specifically for its acoustical insulating properties. Alternatively, the insulation material may be a mixture of different materials either in a series of laminations or a particulate mixture, or some combination of the two. The outer layers or coverings which may be fabric, tack board or other suitable material, are selected for aesthetic as well as functional requirements. The material may be selected in specific colors to match or coordinate with a particular interior decorating scheme or concept. If outer layers of insulating material are used, as in the FIG. 2 embodiment, these layers may be fiberglass or a more rigid material depending upon the functional aspects desired for the finished panel.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A modular acoustical panel for use in separating and dividing interior space comprises:

a frame member having a wall portion which surrounds and defines a core-receiving space; and a modular septum attached to said frame member and including two layers of insulating material separated by an offset partition, said offset partition including a center portion, an outer flange portion spaced apart from said center portion and an offset wall disposed between and connecting said center portion with said outer flange portion.

2. The modular acoustical panel of claim 1 wherein said frame member is of a generally rectangular, hollow construction.

3. The modular acoustical panel of claim 2 wherein the thickness of said frame is twice the length of said offset wall.

4. The modular acoustical panel of claim 1 which further includes a first outer layer of covering material disposed over one layer of said two layers of insulation material and a second outer layer of covering material disposed over the other layer of said two layers of insulation material.

5. The modular acoustical panel of claim 1 which further includes a frame-like spacer having a peripheral size and shape substantially the same as the peripheral size and shape of said frame member, said frame-like spacer being disposed up against said frame member.

6. The modular acoustical panel of claim 5 wherein the thickness of said spacer is substantially equal to the thickness of said flange portion of said offset partition.

7. The modular acoustical panel of claim 1 wherein the peripheral size and shape of said offset partition is substantially the same as the peripheral size and shape of said frame member.

8. The modular acoustical panel of claim 7 wherein the peripheral size and shape of said two layers of insulating material are substantially the same as the size and shape of the inner peripheral edge of said core-receiving space.

9. The modular acoustical panel of claim 8 wherein the peripheral size and shape of said first and second outer layers of covering material are substantially the same as the peripheral size and shape of said frame member.

10. The modular acoustical panel of claim 9 wherein the outer surface of each of said two layers of insulating material of said modular septum are substantially flush with their corresponding outer surface sides of said frame.

11. A modular acoustical panel for use in separating and dividing interior space comprises:

a frame member having a wall portion which surrounds and defines a core-receiving space; and a modular septum attached to said frame member and including two layers of insulating material separated by an offset partition and a third layer of insulation material disposed over one of said two layers of insulating material and over a surrounding portion of said partition, said offset partition including a center portion, an outer flange portion spaced apart from said center portion and an offset wall disposed between and connecting together said center portion and said outer flange portion.

12. The modular acoustical panel of claim 11 wherein said third layer of insulation material has a peripheral size and shape substantially the same as the peripheral size and shape of said surrounding flange portion.

13. The modular acoustical panel of claim 11 which further includes a modular spacer including a generally frame-shaped spacer member and a layer of insulating material applied to said spacer member, said modular spacer being disposed up against said frame member.

14. The modular acoustical panel of claim 13 wherein the thickness of said modular spacer is substantially the same as the combined thickness of said surrounding flange and third layer of insulation material.

15. The modular acoustical panel of claim 11 wherein the combined thickness of said center portion and said two layers of insulating material is substantially equal to the thickness of said frame member.

16. A modular acoustical panel for use in separate and dividing interior space comprises:

a frame member having an inner wall portion which surrounds and defines a core-receiving space and an outer peripheral lip portion adjacent the outer periphery of said inner wall portion, said inner wall portion including a front surface inset from said outer peripheral lip portion;

a modular septum attached to said frame member and including two layers of insulating material separated by an offset partition, said offset partition including a center portion, a surrounding flange portion and an offset wall disposed between and connecting together said center portion and said outer flange portion;

exterior covering means disposed over each layer of insulating material; and the center portion of said modular septum fitting within said core-receiving space and said modular septum being attached to said frame member by placement of said outer flange portion of said partition into abutment against said front surface.

17. A method of constructing a modular acoustical panel for use in separating and dividing interior space comprises the following steps:

providing a generally rectangular frame which has a wall portion that surrounds and defines a core-receiving space;

providing an offset septum partition including a center portion, an outer flange portion spaced apart from said center portion and an offset wall disposed between and connecting together said center portion and said outer flange portion;

attaching a first panel of insulation material to one side of the partition over said center portion;

attaching a second panel of insulation material to the other side of the partition over said center portion;

inserting the center portion of said partition into said core-receiving space;

attaching said flange portion to said frame; and covering each side of the frame assembly with a covering material.

* * * * *

UNITED STATES PATENT AND TRADEMARK OFFICE

CERTIFICATE OF CORRECTION

PATENT NO. : 4,964,250

DATED : October 23, 1990

INVENTOR(S) : Thomas E. Nelson

It is certified that error appears in the above-identified patent and that said Letters Patent is hereby corrected as shown below:

In column 2, line 19, please change "aPplied" to --applied--.

In column 4, line 18, please change "broken, line" to --broken line--.

Signed and Sealed this

Twenty-fifth Day of February, 1992

*Attest:*

HARRY F. MANBECK, JR.

*Attesting Officer*

*Commissioner of Patents and Trademarks*